US007954244B2

(12) United States Patent
Orloff et al.

(10) Patent No.: US 7,954,244 B2
(45) Date of Patent: Jun. 7, 2011

(54) RAZOR CARTRIDGE WITH COMB

(75) Inventors: Glennis J. Orloff, Woodbridge, CT (US); Gregg A. Micinilio, Trumbull, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 439 days.

(21) Appl. No.: 12/100,600

(22) Filed: Apr. 10, 2008

(65) Prior Publication Data

US 2008/0250644 A1 Oct. 16, 2008

Related U.S. Application Data

(60) Provisional application No. 60/923,158, filed on Apr. 12, 2007.

(51) Int. Cl.
*B26B 21/14* (2006.01)
*B26B 21/40* (2006.01)

(52) U.S. Cl. ..... 30/50; 30/77

(58) Field of Classification Search ..... 30/34.05, 30/50, 77, 78, 79
See application file for complete search history.

(56) References Cited

U.S. PATENT DOCUMENTS

| | | | | | |
|---|---|---|---|---|---|
| 1,747,151 | A | * | 2/1930 | Gaisman | 30/38 |
| 1,887,911 | A | * | 11/1932 | Aronson | 30/36 |
| 2,227,996 | A | * | 1/1941 | Bassett et al. | 30/43.1 |
| 2,588,033 | A | | 3/1952 | O'Gatty | |
| 2,959,853 | A | * | 11/1960 | Mercer | 30/31 |
| 5,386,750 | A | | 2/1995 | Morrison | |
| 5,669,139 | A | | 9/1997 | Oldroyd et al. | |

FOREIGN PATENT DOCUMENTS

| | | |
|---|---|---|
| FR | 570743 | 5/1924 |
| GB | 193641 | 3/1923 |

OTHER PUBLICATIONS

International Search Report for PCT/US2008/059871, dated Jul. 16, 2008.

* cited by examiner

*Primary Examiner* — Stephen Choi
(74) *Attorney, Agent, or Firm* — Energizer Personal Care, LLC

(57) ABSTRACT

A multi-function razor cartridge that can be used for hair trimming and normal shaving has a housing including a retractable guard and at least one razor blade having a cutting edge. The razor cartridge also has a comb mounted to the housing that is movable by a user between a non-operable position and an operable position. When the comb is in the non-operable position the razor cartridge can be used for a normal shaving operation. As the comb is moved to the operable position for hair trimming, the guard is retracted so that it will not interfere with the passage of longer hairs between the teeth of the comb.

4 Claims, 3 Drawing Sheets

RAZOR CARTRIDGE WITH COMB

CROSS REFERENCE TO RELATED APPLICATIONS

This application claims the benefit of U.S. Provisional Patent application Ser. No. 60/923,158, filed Apr. 12, 2007.

TECHNICAL FIELD

The present invention is related to shaving implements in general and, more particularly, to shaving implements having improved abilities to shave a skin surface or trim hair.

BACKGROUND

Shaving implements typically include a razor cartridge mounted to a handle. The cartridge includes a housing having at least one razor blade having a cutting edge, that is located aft of a guard of the housing and forward of a cap of the housing. Razor cartridges of this type are generally used to shave a skin surface of a user, that is, in the context of the present application to cut or otherwise remove unwanted hair to approximately the level of the skin surface.

Some hair trimming devices typically include a comb having a plurality of parallel teeth and a razor blade having a cutting edge. The comb can be on one or both sides of the cutting edge. Hair trimming in the context of the present application is defined as the operation of reducing the length of longer hair to a level spaced away from the level of the skin surface.

U.S. Pat. No 5,386,750 to Morrison discloses a safety razor having a detachable comb that can be attached to the razor cartridge of the safety razor so that the device has additional utility for trimming hair. If a user mislays the detachable comb of the Morrison device, its utility as a hair trimmer is diminished. When in use, the comb of the Morrison device overlays a permanently fixed guard of the safety razor. In this mode, the guard can obstruct the passage of longer hairs between the teeth of the comb and can reduce the device's efficiency as a hair trimmer.

SUMMARY

The present invention has for its objective to eliminate, or at least substantially alleviate the limitations of the prior art by providing a razor cartridge that has a trimming comb permanently attached thereto. The trimming comb can be moved between a non-operable, parked position and an operable, trimming position. When the trimming comb is in the operable position, the guard of the cartridge is retracted from its shaving position so that it will not interfere with the passage of longer hairs between the teeth of the comb. In this manner the razor cartridge has utility for both normal shaving and efficient hair trimming.

DETAILED DESCRIPTION

Figure 1:
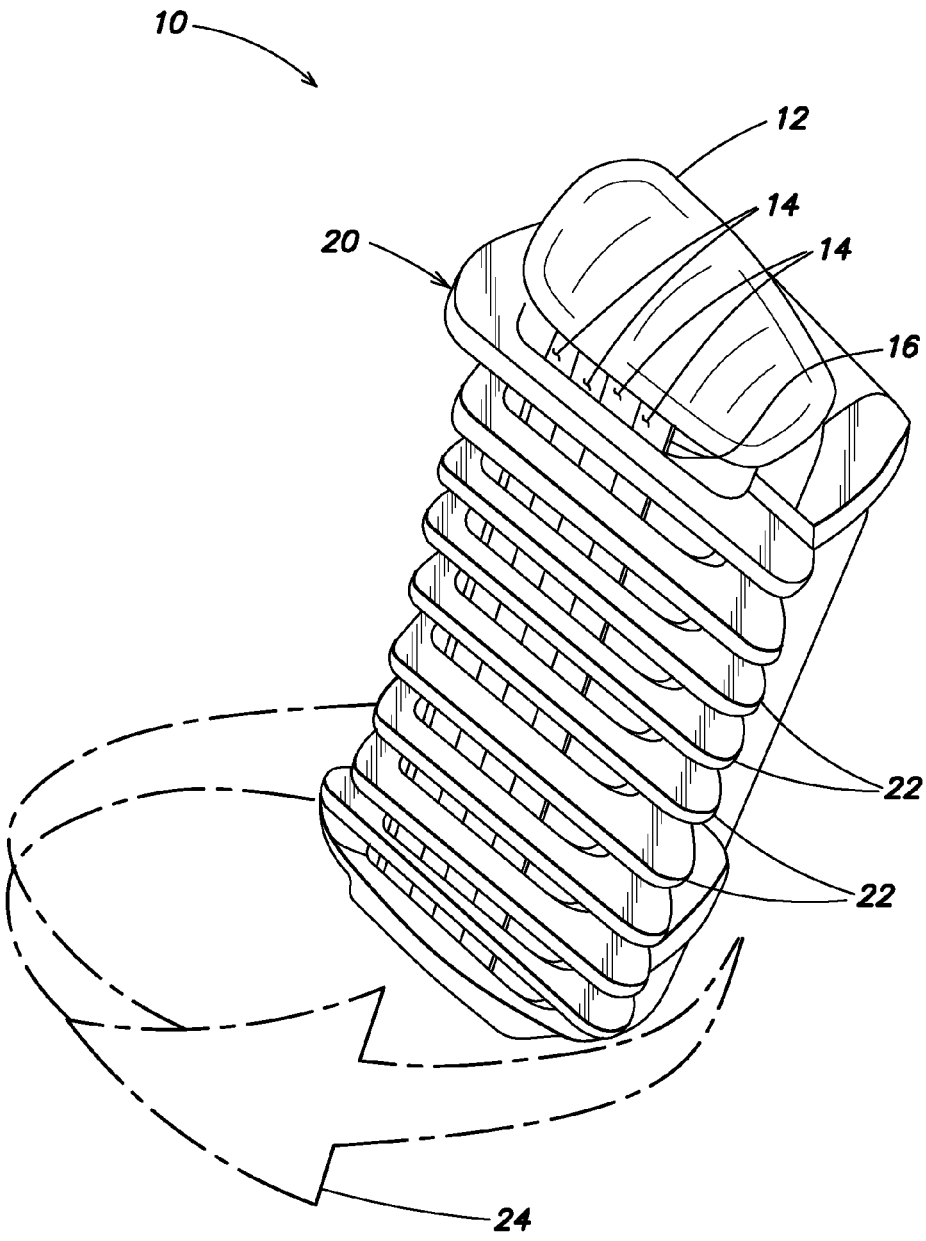
FIG. 1 is an isometric view of an embodiment of the razor cartridge of the present invention with an attached comb in the operable position.

Referring to the drawings and in particular FIG. 1 an exemplary embodiment of a razor cartridge of the present invention is shown generally at 10. The razor cartridge 10 includes a housing 12 having one or more razor blades 14 disposed therein. Each razor blade has a cutting edge 16. In the razor cartridge depicted, four razor blades are shown, but the present invention is not limited in this regard and more or less than four razor blades can be usefully employed. The razor cartridge has a comb 20 pivotally coupled to a portion of the housing. The comb includes a plurality of parallel spaced teeth 22. In the embodiment depicted in FIG. 1 the comb 20 is in its operable position and the razor cartridge is adapted for efficient hair trimming. The comb 20 is pivotally movable by a user to a non-operable position generally in the direction of arrow 24 wherein the razor cartridge is adapted for efficient shaving.

Figure 3:
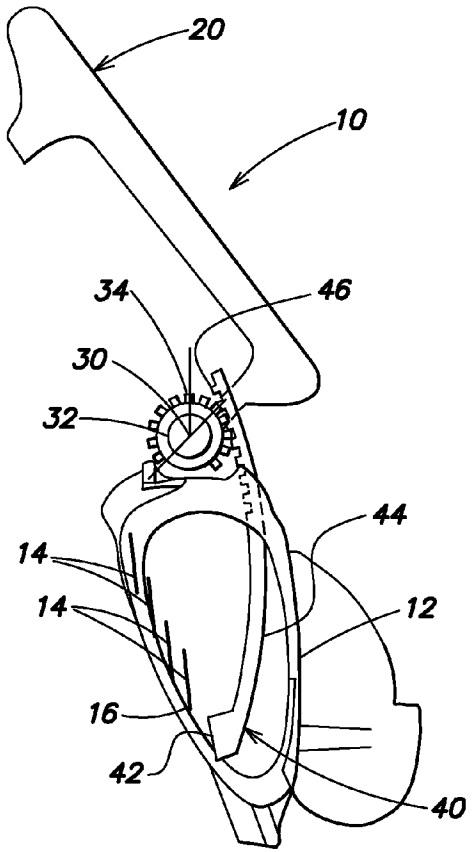
FIG. 3 is a schematic side view of the razor cartridge of FIG. 1 with the attached comb in the non-operable position.
Figure 2:
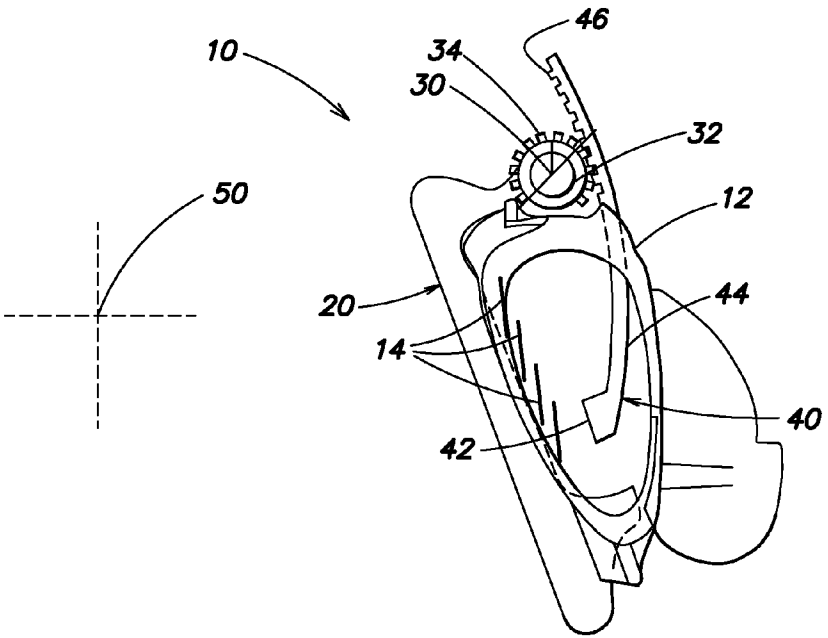
FIG. 2 is a schematic side view of the razor cartridge of FIG. 1 with the attached comb in the operable position.

Referring additionally now to FIGS. 2-3, the razor cartridge 10 is schematically depicted with its comb 20 in the non-operable position (in FIG. 3, i.e. for use of the cartridge for normal shaving) and in the operable position (in FIG. 2, i.e. for use of the cartridge for trimming). The comb is pivotal coupled to the housing 12 of the cartridge and movable between its two positions about an axis 30 preferably disposed at the rear of the housing. The comb has a shaft 32 provided with gear-tooth-like protrusions 34 disposed at least partially around the outer surface of the shaft so that the shaft comprises the pinion part of a commonly known rack and pinion mechanism. The cartridge includes a guard 40. The guard has a skin engaging surface 42 that is disposed forward of the cutting edges of the razor blades for conventional shaving when the comb is in the non-operable position. The guard has a rearward extending member 44. Member 44 is provided with mating gear-tooth-like protrusions 46 so that the member comprises the rack part of the rack and pinion mechanism. When a user pivots the comb from its non-operable position to its operable position, the protrusions 34 of the shaft 32 engage between the protrusions 46 of the member 44 and thus pivotal movement of the comb causes the guard to withdraw to a retracted position, preferably located under one or more of the blades 14. Motion of the guard can be linear or, preferably, arcuate about a far-spaced axis 50. In this manner, when the comb is in its operable position and used for normal hair trimming, the guard does not hinder the passage of longer hairs between the teeth of the comb. When a user wishes to use the razor cartridge for normal shaving, the user pivots the comb away from the operable position. In turn the protrusions 34 of the shaft 32 engage between the protrusions 46 of the member 44 in a reverse manner to that described above and the guard is returned to its shaving position.

Figure 4:
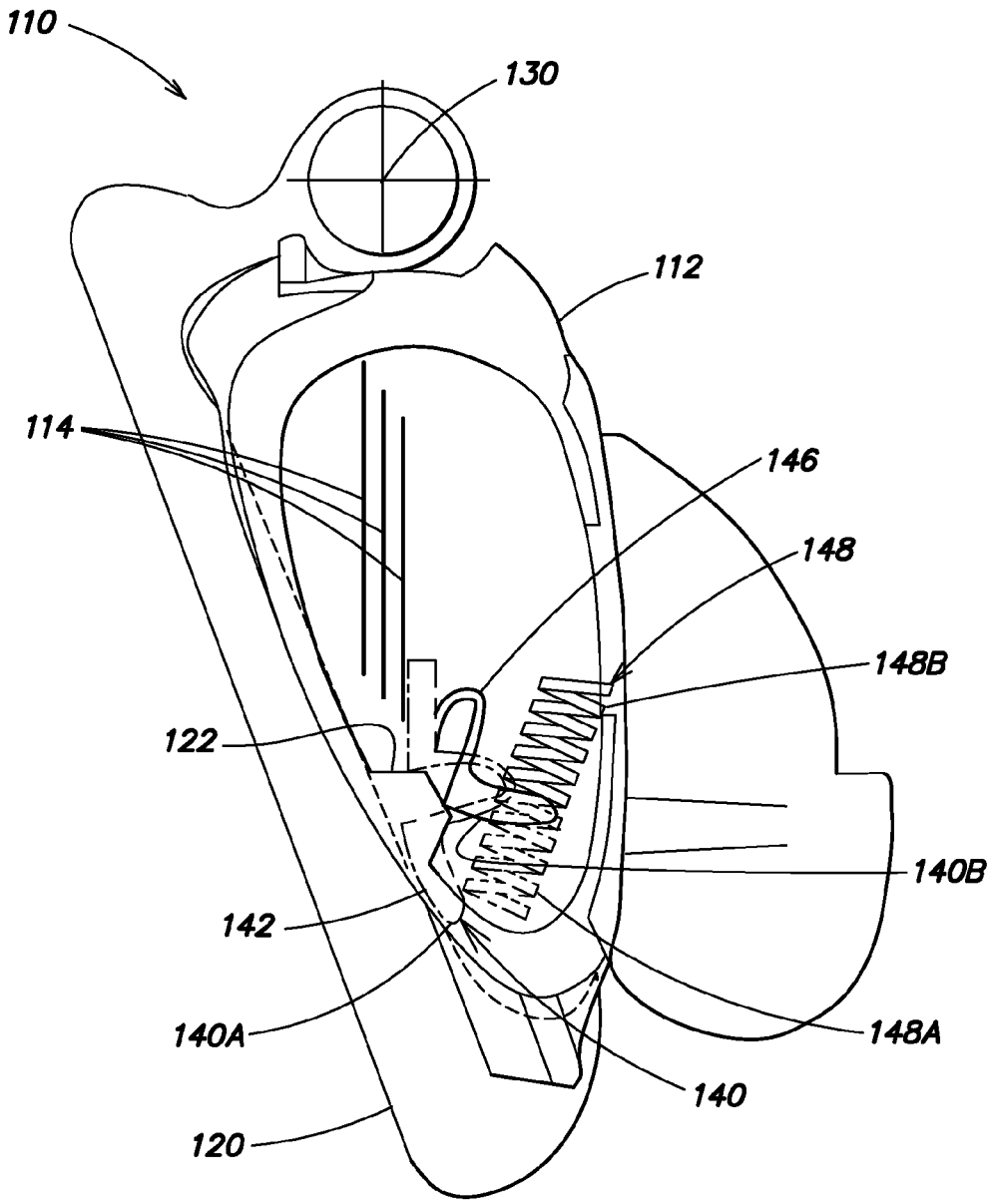
FIG. 4 is a schematic side view of another embodiment of the razor cartridge of the present invention.

Referring now to FIG. 4, a further embodiment of a razor cartridge of the present invention is schematically shown generally at 110. The razor cartridge 110 includes a housing 112 having one or more razor blades 114 disposed therein. The razor cartridge has a comb 120 pivotally coupled to the housing and movable about an axis 130. As depicted, the comb is in its operable position for hair trimming. The cartridge has a guard 140 having a skin engaging surface 142 that can be disposed forward of the cutting edges of the razor blades for conventional shaving when the comb is in the non-operable position. The guard is attached to the housing by a flexible web 146. When the comb is in the operable position a protrusion 122 of the comb directly or indirectly contacts the guard 140 and elastically flexes the flexible web so that the guard moves away from its shaving position to a retracted position. In this manner, when the comb is in its operable position and used for normal hair trimming, the guard does not hinder the passage of longer hairs between the teeth of the comb. An additional biasing member may also be provided that preferably includes a compression spring 148 to act on the guard to provide a biasing force to urge the guard to its shaving position and thus return the guard to its shaving position for normal shaving when the comb is pivoted away from to its operable position and the protrusion 122 disengages the guard. For convenience, FIG. 4 shows the guard 140 in its shaving position 140A in dashed lines and in its retracted position 140B in solid lines. Spring 148 is shown contacting the guard in its extended state 148A in dashed lines and in its compressed state 148B in solid lines.

As described above, the razor cartridge has utility for both normal shaving and efficient hair trimming.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. For instance, features disclosed in connection with any one embodiment can be used alone or in combination with each feature of the respective other embodiments. Those skilled in the art will further recognize that variations and modifications can be made within the scope of the invention. For instance, the guard of the embodiment of FIG. 4 may be pivotally attached to the housing.

What is claimed is:

1. A razor cartridge, comprising:

a housing including at least one razor blade having a cutting edge mounted therein;

a comb attached to the housing, the comb including a plurality of parallel spaced teeth and a shaft defining a pinion, and being moveable by a user between a non-operable position and an operable position; and a guard moveably attached to the housing and disposed forward of the at least one razor blade, the guard including a skin engaging surface and a member defining a rack, the guard being moveable between a shaving position and a retracted position;

wherein, when the comb is moved by the user from the non-operable position to the operable position, the comb engages the guard to move the guard from the shaving position to the retracted position and wherein in the operable position the plurality of parallel spaced teeth of the comb overlay the cutting edge of the at least one razor blade;

wherein, when the comb is moved by the user from the operable position to the non-operable position the guard is caused to move from the retracted position to the shaving position.

2. The razor cartridge of claim 1, wherein the comb is pivotally attached to the housing and moveable between the non-operable position and the operable position about an axis disposed at the rear of the housing.

3. The razor cartridge of claim 1, wherein the moveable attachment of the guard to the housing is a slidable attachment and wherein the guard is slidable along a path defined by one of an arc and a straight line.

4. The razor cartridge of claim 1, wherein movement of the comb causes the pinion of the comb to engage the rack of the guard and in turn to cause the guard to move.

* * * * *